US005449170A

United States Patent [19]

Clements

[11] Patent Number: 5,449,170

[45] Date of Patent: Sep. 12, 1995

[54] HOCKEY GOAL ARRANGEMENT

[76] Inventor: Steven A. Clements, P.O. Box 74, Passadumkeag, Me. 04475

[21] Appl. No.: 349,459

[22] Filed: Dec. 5, 1994

Related U.S. Application Data

[63] Continuation of Ser. No. 191,398, Feb. 2, 1994, abandoned.

[51] Int. Cl.[6] ..... A63F 7/06

[52] U.S. Cl. ..... 273/85 R; 273/127 B; 273/57.2

[58] Field of Search ..... 273/57.2, 85 R, 126 R, 273/127 R, 127 B, 127 D, 118 R, 348; D6/334, 335, 349, 350; 297/461, 344.21, 344.22, 344.26, 423.41, 423.44

[56] References Cited

U.S. PATENT DOCUMENTS

| | | | |
|---|---|---|---|
| D. 337,211 | 7/1993 | Bergkvist | D6/349 |
| 2,528,950 | 11/1950 | Engstrom | 297/344.26 |
| 2,648,579 | 8/1953 | Slyter et al. | 297/344.26 |
| 3,590,754 | 7/1971 | Jakobsen | 108/161 |

*Primary Examiner*—Vincent Millin
*Assistant Examiner*—William M. Pierce

[57] ABSTRACT

A goal structure for use in the playing of miniature hockey includes a housing having side walls, with at least one of the side walls including an opening, and the opening including a cushion perimeter to minimize uncontrolled deflection of the hockey projectile, with a cushion mounted to a top wall of the housing to accommodate an individual thereon.

7 Claims, 3 Drawing Sheets

FIG 1
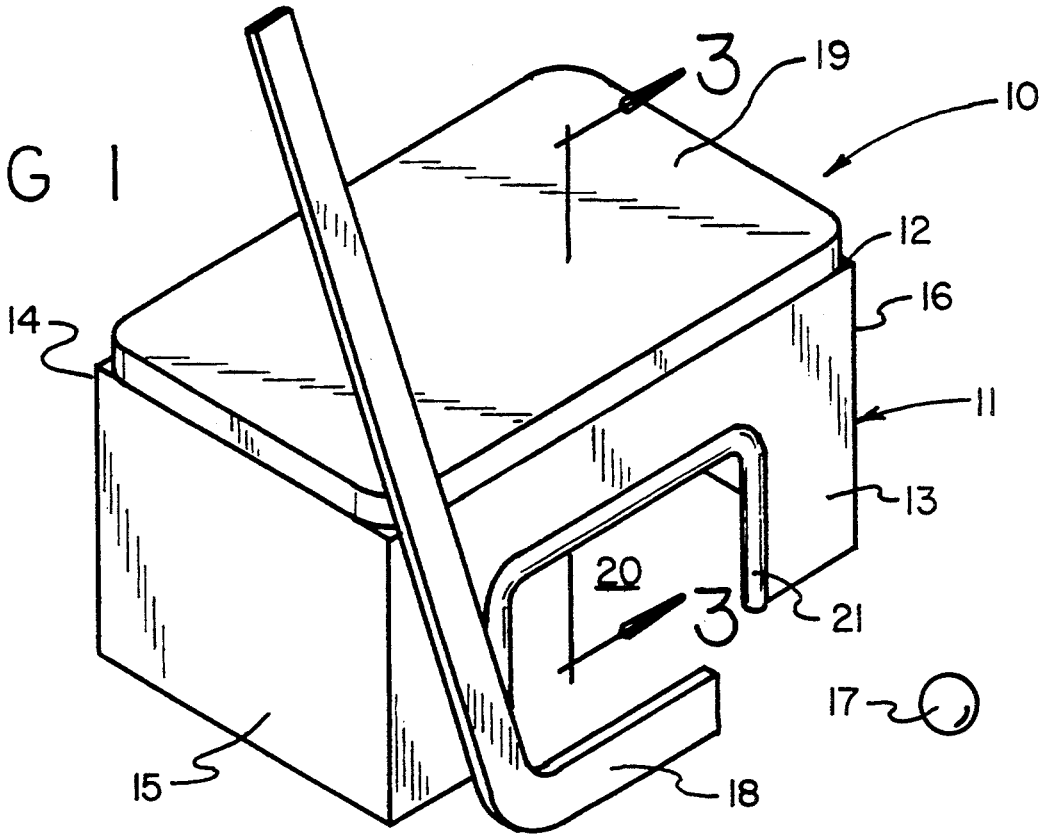
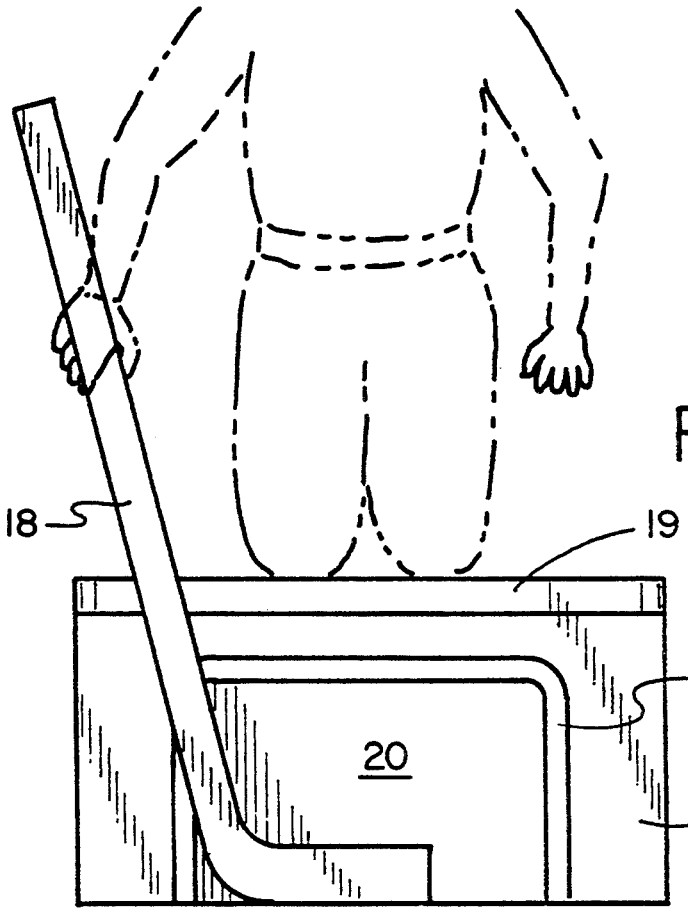
FIG 2

HOCKEY GOAL ARRANGEMENT

This application is a continuation of application 08/191,398, filed Feb. 2, 1994, now abandoned.

BACKGROUND OF THE INVENTION

1. Field of the Invention

The field of invention relates to hockey apparatus, and more particularly pertains to a new hockey goal arrangement wherein the same is arranged to provide for a hockey goal structure relative to use in the playing of miniature hockey.

2. Description of the Prior Art

Miniature hockey typically played indoors is arranged to employ various game pucks such as spheres, cylinders, and the like typically formed of various materials such as softened polymerics and the like. Even bottle caps and ping pong balls may be employed as a game puck.

Prior art has heretofore employed various structure to provide for a hockey goal, such as indicated in U.S. Pat. Nos. 3,979,120; 3,840,228; 3,698,715; as well as U.S. Pat. No. 4,018,443.

The present invention attempts to overcome deficiencies in the prior art by providing a goal structure for use in the playing of miniature hockey including a housing with a cushion mounted to a top wall of the housing to accommodate an individual thereon.

SUMMARY OF THE INVENTION

In view of the foregoing disadvantages inherent in the known types of hockey goal structure now present in the prior art, the present invention provides a hockey goal arrangement wherein the same sets forth a housing arranged to accommodate an individual thereon in play of miniature hockey. As such, the general purpose of the present invention, which will be described subsequently in greater detail, is to provide a new hockey goal arrangement apparatus and method which has many of the advantages of the prior art listed heretofore and many novel features that result in a hockey goal arrangement apparatus which is not anticipated, rendered obvious, suggested, or even implied by any of the prior art, either alone or in any combination thereof.

To attain this, the present invention provides a goal structure for use in the playing of miniature hockey includes a housing having side walls, with at least one of the side walls including an opening, and the opening including a cushion perimeter to minimize uncontrolled deflection of the hockey projectile, with a cushion mounted to a top wall of the housing to accommodate an individual thereon.

There has thus been outlined, rather broadly, the more important features of the invention in order that the detailed description thereof that follows may be better understood, and in order that the present contribution to the art may be better appreciated. There are of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured by the claims, nor is it intended to be limiting as to the scope of the invention in any way.

It is therefore an object of the present invention to provide a new hockey goal arrangement apparatus and method which has many of the advantages of the prior art listed heretofore and many novel features that result in a hockey goal arrangement apparatus which is not anticipated, rendered obvious, suggested, or even implied by any of the prior art, either alone or in any combination thereof.

It is another object of the present invention to provide a new hockey goal arrangement which may be easily and efficiently manufactured and marketed.

It is a further object of the present invention to provide a new hockey goal arrangement which is of a durable and reliable construction.

An even further object of the present invention is to provide a new hockey goal arrangement which is susceptible of a low cost of manufacture with regard to both materials and labor, and which accordingly is then susceptible of low prices of sale to the consuming public, thereby making such hockey goal arrangements economically available to the buying public.

Still yet another object of the present invention is to provide a new hockey goal arrangement which provides in the apparatuses and methods of the prior art some of the advantages thereof, while simultaneously overcoming some of the disadvantages normally associated therewith.

It is yet a further object of the present invention to provide a new hockey goal arrangement having side walls, with at least one of the side walls including an opening, and the opening including a cushion perimeter to minimize uncontrolled deflection of an impacting hockey projectile.

Still yet another object of the present invention to provide a new hockey goal arrangement having side walls and a top wall, with at least one of the side walls including an opening, and with the top wall having a cushioned surface to accommodate an individual thereon.

These together with other objects of the invention, along with the various features of novelty which characterize invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the invention.

FIG. 2 is a front elevation view of the invention.

DESCRIPTION OF THE PREFERRED EMBODIMENT

Figure 3:
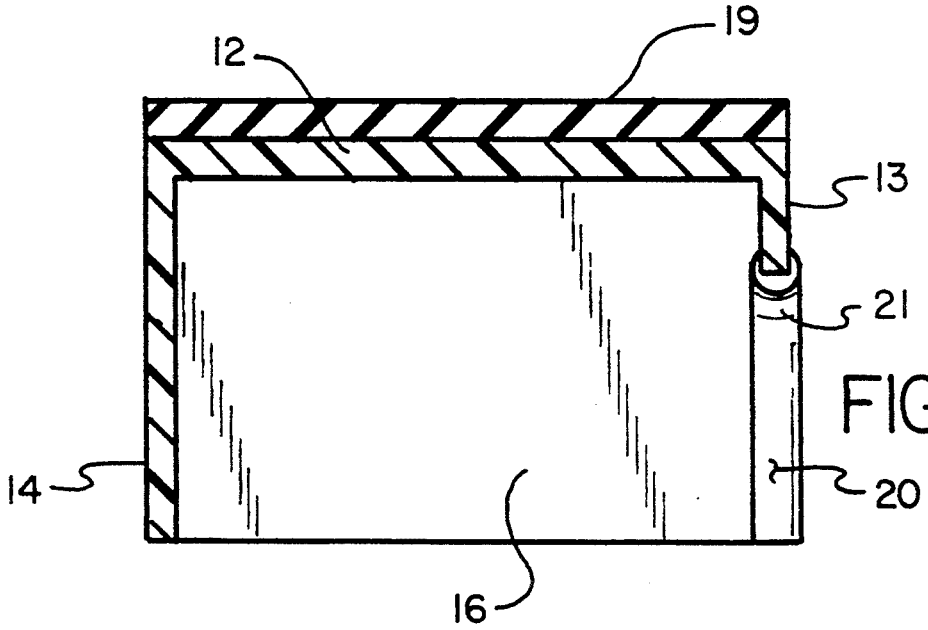
FIG. 3 is a cross sectional view, taken along the lines 3—3 of FIG. 1 in the direction indicated by the arrows.

With reference now to the drawings, and in particular to FIGS. 1-6 thereof, a new hockey goal arrangement embodying the principles and concepts of the present invention and generally designated by the reference numerals 10 and 10*a* will be described.

More specifically, the hockey goal arrangement 10, as set forth in the FIGS. 1-4, includes a housing 11 having a top wall 12, a first side wall 13 spaced from a second side wall 14, and a first end wall 15 spaced from a second end wall 16. The walls 12-16 cooperate to define a substantially rectangular enclosure which may be positioned upon a ground surface suitable for playing the game, such surfaces including carpet, tile, and the like.

A game puck 17, such as a sphere, a cylinder, or the like, is provided in cooperation with an L-shaped hockey stick 18, whereupon an individual positioned upon a cushion pad 19 mounted upon the top wall 12 attempts to deflect the game puck from entering through a first side wall entrance opening 20 having a first side wall cushion perimeter portion 21 that is provided to prevent uncharacteristic deflection of the game puck which may result in an unintentional striking of associated players.

Figure 4:
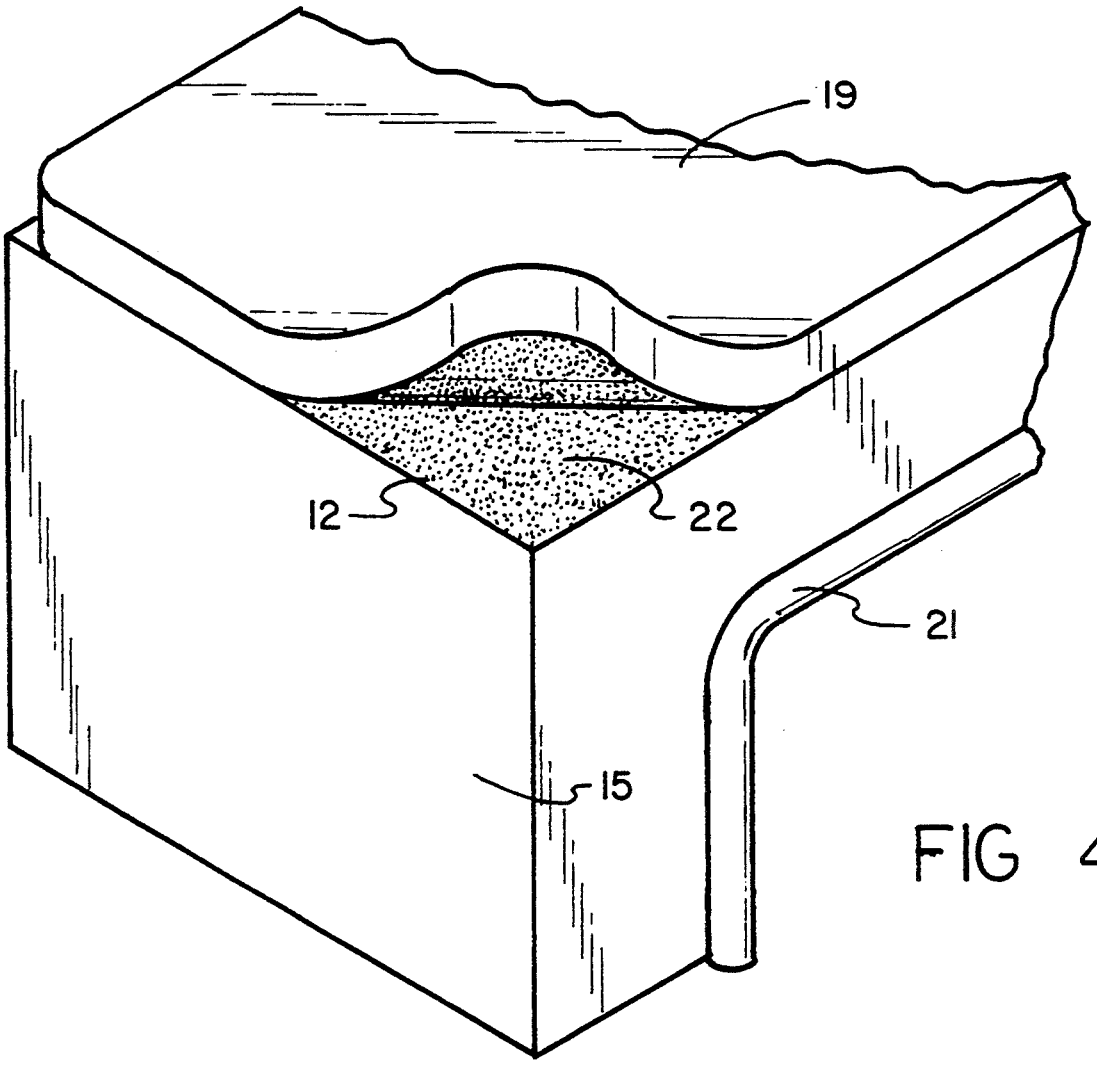
FIG. 4 is an isometric partial view indicating adhesive mounting of the cushion layer onto the top wall of the hockey goal housing.

FIG. 4 indicates that an adhesive interface 22 is oriented between the cushion pad 19 and the top wall 12 for adherence of the cushion pad to the top wall.

In play, two of the goal arrangements 10 may be positioned a predetermined distance apart, whereby opposing players may be situated on top of respective goals in a kneeling or sitting position. The puck 17 may then be placed on the ground, whereby opposing players, each utilizing hockey stick 18, strike the puck and attempt to project it through the side wall entrance opening 20 of the opposing player's goal arrangement 10 to score a predetermined number of points.

Figure 5:
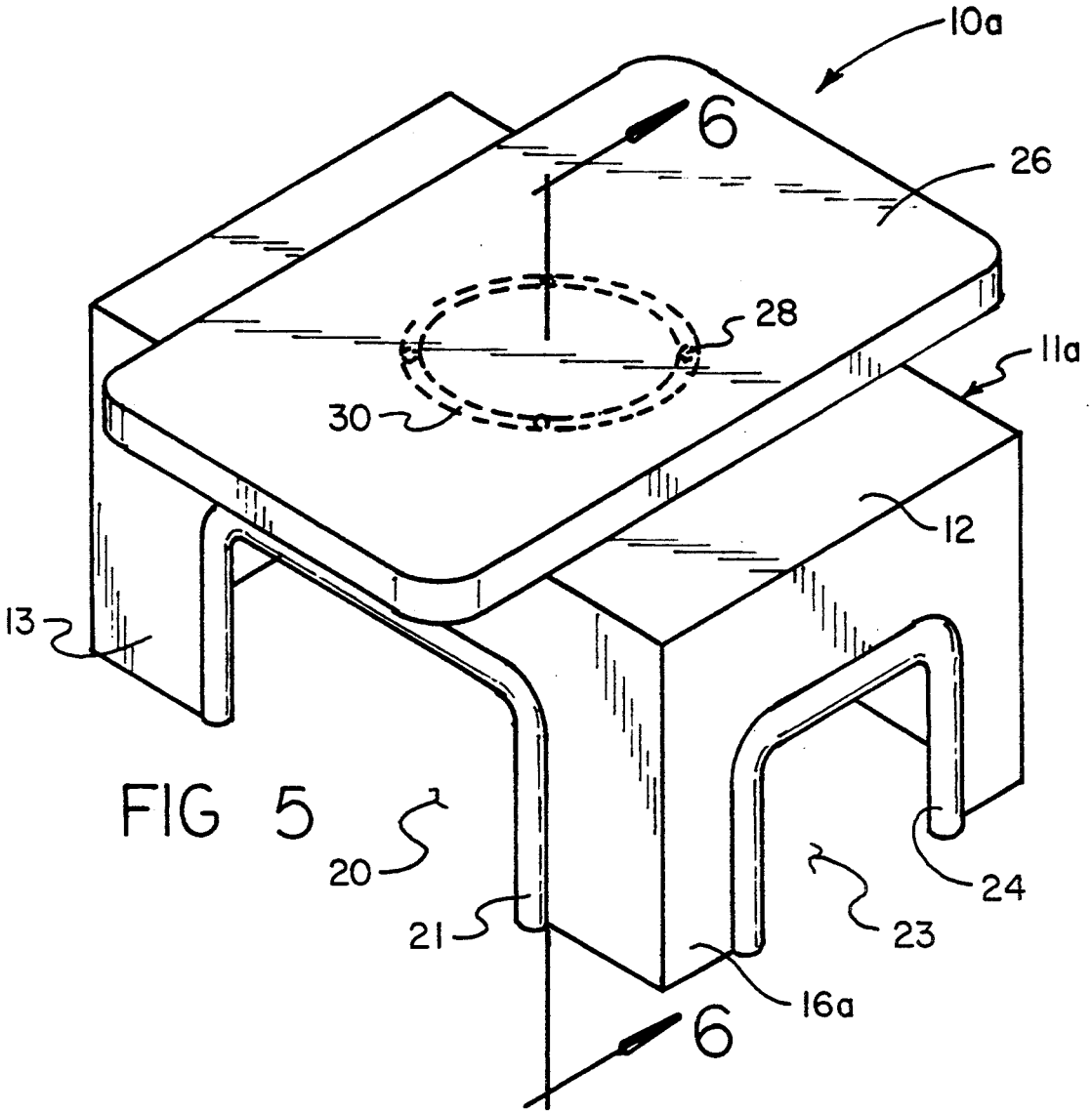
FIG. 5 is an isometric illustration of a modified housing structure.
Figure 6:
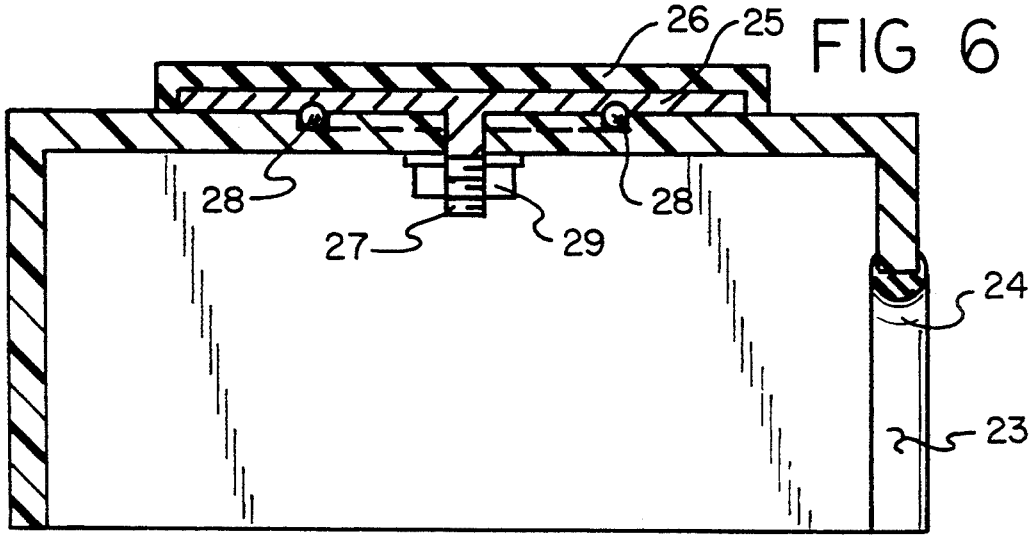
FIG. 6 is an orthographic view, taken along the lines 6—6 of FIG. 5 in the direction indicated by the arrows.

FIGS. 5 and 6 illustrate a modified hockey goal arrangement 10*a*, wherein a modified housing 11*a* includes a modified second end wall 16*a* to include a second end wall goal opening 23, as well as a second end wall cushion perimeter portion 24 to provide for scoring of goals through a plurality of entrance openings 20, 23. If desired, the remaining end wall 15 may be provided with a similar entrance opening to provide an entrance opening through a plurality of the walls of the housing 11*a*.

As best illustrated by the cross section in FIG. 6, the hockey goal arrangement 10*a* utilizes a rotary plate 25 which includes a rotary plate cushion 26 secured thereon. A rotary plate shaft 27 forming an integral part of the rotary plate 25 is rotatably directed through the top wall 12 and fastened within the housing 11*a* by a shaft fastener 29 to mount the rotary plate thereto. Bearing members 28 positioned within an annular bearing groove 30 between the rotary plate 25 and the top wall 12 permit a rotation of the rotary plate 25 and the associated rotary plate cushion 26. This arrangement provides for the re-orientation of an individual onto the housing 11*a* without necessitating movement of that individual relative to the plate cushion 26.

As to the manner of usage and operation of the instant invention, the same should be apparent from the above disclosure, and accordingly no further discussion relative to the manner of usage and operation of the instant invention will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A hockey goal arrangement, comprising:

a housing means for receiving and capturing a game puck, said housing means comprising a substantially rectangular housing having a top wall, a first side wall spaced from a second side wall, and a first end wall spaced from a second end wall, said walls extending downwardly from said top wall to define an enclosure when said housing is positioned upon a ground surface, said first side wall having a first side wall goal opening directed through the first side wall, whereby a game puck can be positioned within said housing only through said opening when said housing is placed upon said ground surface; and, first cushion means extending about the first side wall goal opening for attenuating an impact of a game puck against a perimeter of said first side wall goal opening, said first cushion means comprising a first side wall cushion perimeter portion extending about the first side wall goal opening, whereby an impact of said game puck against said perimeter of said goal opening is attenuated to reduce deflection of said game puck.

2. A hockey goal arrangement as set forth in claim 1, and further including a rotary plate having a shaft fixedly mounted orthogonally to the rotary plate, with the shaft rotatably directed through the top wall, with a fastener mounted to the shaft within the housing, and a cushion secured onto the rotary plate.

3. A hock goal arrangement as set forth in claim 2, including an annular bearing groove directed into the top wall between the rotary plate and the top wall, with the annular bearing groove including a plurality of bearing members contained therewithin to rotatably orient the rotary plate relative to the top wall.

4. The hockey goal arrangement as set forth in claim 1, and further comprising a cushion pad mounted upon the top wall and coextensive therewith.

5. The hockey goal arrangement as set forth in claim 4, wherein said cushion pad is adhesively attached to said top wall.

6. A method of playing hockey, said method comprising the steps of:

(a) designating a first player and a second player;

(b) positioning a first hockey goal arrangement upon a ground surface, said first hockey goal arrangement comprising a first housing having atop wall, a first side wall spaced from a second side wall, a first end wall spaced from a second end wall, and a first side wall goal opening directed through the first side wall; a cushion pad adhesively attached to said top wall, and a first side wall cushion perimeter portion extending about the first side wall goal opening;

(c) positioning a second hockey goal arrangement upon the ground surface and spaced from said first hockey goal arrangement, said second hockey goal arrangement comprising a second housing having a top wall, a first side wall spaced from a second side wall, a first end wall spaced from a second end wall, and a first side wall goal opening directed through the first side wall; a cushion pad adhesively attached to said top wall, and a first side wall cushion perimeter portion extending about the first side wall goal opening;

(d) positioning said first player upon said first hockey goal arrangement, said positioning comprising kneeling on said top wall of said first housing, whereby both feet of said first player are positioned proximal to said second side wall of said first housing;

(e) positioning said second player upon said second hockey goal arrangement, said positioning comprising kneeling on said top wall of said second housing, whereby both feet of said second player are positioned proximal to said second side wall of said second housing;

(f) placing a puck on the ground surface;

(g) striking the puck by either player in an attempt to project the puck through an opposing player's side wall goal opening;

(h) scoring by awarding a predetermined number of points to the player who successfully projects said puck through said opposing player's side wall goal opening;

(i) repeating steps (g) and (h) until a winner is declared by one of said players.

7. A hockey goal arrangement comprising:

a housing means for receiving and capturing a game puck, said housing means comprising a substantially rectangular housing having a top wall, a first side wall spaced from a second side wall, and a first end wall spaced from a second end wall, said walls extending downwardly from said top wall to define an enclosure when said housing is positioned upon a ground surface, said first side wall having a first goal opening directed through the first side wall, and said second end wall having a second goal opening directed through said second end wall, whereby a game puck can be positioned within said housing only through said openings when said housing is placed upon said ground surface;

first cushion means extending about the first side wall goal opening for attenuating an impact of a game puck against a perimeter of said first side wall goal opening, said first cushion means comprising a first side wall cushion perimeter portion extending about the first side wall goal opening, whereby an impact of said game puck against a said perimeter of said first goal opening is attenuated to reduce deflection of said game puck;

second cushion means extending about the second goal opening for attenuating an impact of a game puck against a perimeter of said second goal opening, said second cushion means comprising a second side wall cushion perimeter portion extending about the second goal opening, whereby an impact of said game puck against said perimeter of said second goal opening is attenuated to reduce deflection of said game puck;

a rotary plate having a shaft fixedly mounted orthogonally to said rotary plate, with the shaft rotatably directed through said top wall of said housing, with a fastener mounted to said shaft within said housing, said top wall having an annular bearing groove located beneath said rotary plate, with the annular bearing groove including a plurality of bearing members contained therewithin to rotatably support said rotary plate relative to said top wall; and;

a cushion pad mounted to said rotary plate and coextensive therewith, whereby a player residing upon said rotary plate can rotate with said rotary plate relative to said housing so as to face towards either one of said first and second goal openings.

* * * * *